US006335131B1

(12) United States Patent
Hruska et al.

(10) Patent No.: US 6,335,131 B1
(45) Date of Patent: Jan. 1, 2002

(54) ARTICLES PRINTED BY ELECTROPHOTOGRAPHY

(75) Inventors: Zdenek Hruska, Munich (DE); Claude Dehennau, Waterloo (BE)

(73) Assignee: Solvay, S.A., Brussels (BE)

( * ) Notice: Subject to any disclaimer, the term of this patent is extended or adjusted under 35 U.S.C. 154(b) by 0 days.

(21) Appl. No.: 09/440,090

(22) Filed: Nov. 15, 1999

(30) Foreign Application Priority Data

Nov. 25, 1998 (BE) ..... 09800856

(51) Int. Cl.[7] ..... G03G 13/16; G03C 3/00
(52) U.S. Cl. ..... 430/18; 430/124; 430/126
(58) Field of Search ..... 430/18, 47, 126, 430/124; 428/195; 525/333.8, 356, 358

(56) References Cited

U.S. PATENT DOCUMENTS

| | | | | |
|---|---|---|---|---|
| 3,796,571 A | | 3/1974 | Lerman | |
| 3,873,666 A | | 3/1975 | Lerman | 264/219 |
| 5,073,231 A | | 12/1991 | Eschwey et al. | 156/646 |
| 5,654,378 A | | 8/1997 | Dehennau et al. | 525/333.7 |
| 5,741,548 A | | 4/1998 | Sanduja et al. | 427/261 |
| 5,958,524 A | | 9/1999 | Dehennau et al. | 427/538 |
| 6,051,305 A | * | 4/2000 | Hsu | 428/195 |

FOREIGN PATENT DOCUMENTS

| | | |
|---|---|---|
| EP | 0 629 654 A1 | 12/1994 |
| EP | 0 678 547 A1 | 10/1995 |
| GB | 2 065 032 A | 6/1981 |

* cited by examiner

*Primary Examiner*—Janis L. Dote
(74) *Attorney, Agent, or Firm*—Venable; Marina V. Schneller

(57) ABSTRACT

The invention relates to an article of which at least one surface zone comprises at least one polyolefin and has been printed by means of a toner by an electrophotographic technique, characterized in that the printed zone contains no toner printing primer and in that the adhesion of the toner to the article is such that it withstands a stripping force of at least 0.4 N/mm exerted by means of an adhesive tape. It also relates to a process for the manufacture thereof.

8 Claims, No Drawings

ARTICLES PRINTED BY ELECTROPHOTOGRAPHY

The invention relates to articles based on polyolefins which are printed by electrophotography by means of toners, and to a process for the manufacture thereof.

In numerous applications, articles consisting of plastic, and in particular films, sheets and hollow articles, are printed by means of conventional contact printing techniques such as screen, gravure or flexographic printing, in which a plate carrying in relief the design to be reproduced is inked and then pressed against the substrate to be printed. The inks used in these processes are inks based on solvents in which dyes are dissolved. Techniques for treating the surface of the substrates have also been developed for the purpose of improving the adhesion of these conventional inks to various substrates. For instance, in European Patent Application EP 678398 (Solvay), it is indicated that the oxyfluorination of polyolefinbased articles under specific conditions allows them to be printed using inks for PVC, which is not possible in the absence of this surface treatment.

Recent years have, however, seen the development of contactless printing techniques, an example being the technique of electrophotography. This technique, which is widely used in computer-controlled digital printers, uses inks which are completely different from those used in the contact printing techniques, and which are generally referred to as "toners". These toners are fine powders which in a first stage are deposited on the substrate to be printed and in a second stage are melted, so causing them to adhere to the substrate (an example being the XEIKON® process). These toners, which are generally polymer-based, have characteristics which are entirely different from those of conventional inks, and are not suitable for the same substrates. For instance, the results of attempting to print a polyolefin film by electrophotography, even after corona treatment, are very poor, in the sense that the adhesion of the toner to the film is virtually zero. As a result, the manufacturers of polymer substrates intended for this technique have, in general, to coat their substrates with a thin coating layer that is suitable for printing, based for example on polyethylene terephthalate (PET) or on polyamide. The production of such a coating naturally results in a considerable increase in the cost of the substrate, and may in certain cases impair some of its mechanical, visual or other properties.

The present invention aims to overcome these drawbacks by providing a polyolefin-based article which can be used in processes for printing by electrophotography by means of toners, and which is easy to manufacture and inexpensive.

A first subject of the invention is therefore a polyolefin-based article which is printed by means of a toner by an electrophotographic technique and makes it possible to obtain good adhesion in the absence of a specific printable surface coating.

More specifically, the invention provides an article of which at least one surface zone comprises at least one polyolefin and has been printed by means of a toner by an electrophotographic technique, characterized in that the printed zone contains no toner printing primer and in that the adhesion of the toner to the article is such that it withstands a stripping force of at least 0.4 N/mm exerted by means of an adhesive tape.

The articles referred to within the scope of the present invention can be of any type, in particular films, sheets or plates, or else hollow articles such as bottles, drums, tanks, flasks, pipes, etc. The invention is particularly advantageous in the case of flat articles, especially in the case of films.

These flat articles can be produced by any means, in particular by calendering, by extrusion or by coextrusion, for example by extrusion blow-moulding, extrusion lamination, flat-die extrusion, and by similar coextrusion techniques. In accordance with the invention, at least one surface zone of the article must comprise at least one polyolefin. Preferably, this zone essentially consists of at least one polyolefin. One or more other parts of the article may consist essentially of one or more other materials, such as a metal or a cellulosic material. The invention applies to monolayer and multilayer articles. Thus, for example, the invention applies inter alia to multilayer articles of which at least the printed surface layer is based on polyolefin, it being possible for one or more other layers to consist essentially of one or more other materials.

The term polyolefins is intended to denote not only olefin homopolymers but also copolymers containing at least 70% of olefin-derived units, and also any mixture of such homopolymers and/or copolymers. The term olefin is also intended to denote monoolefins such as ethylene, propylene or butene and olefins containing more than one double bond, for example diolefins such as butadiene. Non-limiting examples of polyolefins which may be mentioned are the polymers of propylene and of ethylene. Interesting results have been obtained with articles whose treated and printed surface zone consists essentially of a propylene polymer or of a mixture of from 50 to 99% (relative to the total weight of the polymers) of at least one propylene polymer and from 50 to 1% of at least one ethylene polymer. The term propylene polymer is intended here to denote a homopolymer or a copolymer containing at least 70% by weight of propylene.

This polyolefin or these polyolefins may further be admixed optionally with one or more conventional mineral fillers, such as calcium carbonate, titanium dioxide, mica; reinforcing fibres such as, for example, glass fibres or carbon fibres, and one or more conventional additives, such as stabilizers, lubricants, antioxidants, etc.

In addition to one or more polyolefins, fillers and additives as set out above, the articles in question may optionally include one or more other polymers intended to give them specific properties—for example, for the purpose of improving their impact strength.

In accordance with the invention, the articles are printed by means of a toner. The term "toner" is intended to denote any solid (pulverulent) ink suitable specifically for printing by electrophotography. In general, these toners, which are well known to the person skilled in the art, contain primarily a thermoplastic resin, a colorant, a charge control agent and, optionally, a magnetic powder (as well as, optionally, certain other additional additives).

The majority constituent of the toner is a thermoplastic resin capable of acting as a binder for the other constituents, such as, in particular, an acrylic polymer [e.g. a copolymer of alphamethylstyrene with alkyl (meth)acrylates], polyesters, or epoxy resins.

As the charge control agent use is made, for example, of nigrosines (or nigrosine derivatives), metal salts of higher fatty acids, alkoxylated amines, certain quaternary ammonium salts, or alkylamides. The amount thereof is generally from 1 to 10 parts relative to the weight of the thermoplastic resin.

Any appropriate colorant can be used, especially carbon black, a dye of the nigrosine type, ultramarine blue, etc. The amount thereof is generally from 1 to 20 parts relative to the weight of the thermoplastic resin.

As other optional additives, mention may be made, for example, of natural or synthetic waxes, fluorinated resins or silicone resins, silica particles, etc.

The optional particles of magnetic powder consist of a ferromagnetic alloy or metal.

A number of ingredients from these various categories may optionally be used in combination.

These various ingredients are generally mixed and ground before being pulverized to give a powder of appropriate particle size (generally of the order of from 0.1 to 5 μm).

Examples of such toners, of their constituents and of the process, for their preparation are provided in particular in the U.S. Pat. Nos. 4,840,863 and 4,299,898.

Processes for printing by electrophotography (xerography) are well known per se, as described for example in the U.S. Pat. Nos. 3,618,552, 2,874,063, 3,251,706, 2,221,776, 3,166,432, 2,986,521. They generally comprise electrically charging certain zones of a cylindrical drum (formation of a latent image), depositing thereon the toner, which has been charged beforehand with an inverse polarity and which will attach itself only to the charged points of the drum, subsequently transferring the toner from the drum to the substrate to be printed, and finally causing it to adhere to the substrate by thermal initiation of the melting of the thermoplastic binder. In one variant, the electrostatic attraction can be replaced by magnetic attraction.

The term toner printing primer is intended here to denote a surface coating which is applied by coating to the surface of the article, whose thickness is of the order of from 0.1 to 10 μm, and which is suitable for printing by a toner. A coating of this kind is considered to be suitable if a substrate thus coated, printed by electrophotography by means of a toner, withstands an adhesive tape stripping test with a force of at least 0.4 N/mm, i.e., if the toner continues to adhere to the said substrate without being transferred to the tape despite the said force being reached. In this test, which is carried out at a temperature of approximately 23° C., the tape is pulled off horizontally, i.e. forming an angle of 360°, at a rate of approximately 100 mm/min. This same test is used to characterize the articles in accordance with the invention.

These primers are generally based on polar polymers (although they may optionally comprise a small amount of polyolefin(s)), for example polyamides, PET or acrylic polymers, and are optionally filled (for example with silica).

The polyolefin-based printed articles thus defined differ from those known to date in the excellent adhesion of the toners, this adhesion being obtained despite the absence of a printing primer coat.

Preferably, the printed surface zone has been surface-treated by means of oxygen and fluorine before its printing.

Advantageously, the said surface zone contains fluorine and oxygen at the surface in concentrations such that the atomic ratio of oxygen to carbon (O/C), measured by ESCA spectroscopy at a depth of 1.5 nm, is at least 0.06 and that the atomic ratio of fluorine to carbon (F/C) has a value of at least 30% of that of the ratio O/C and not more than 350% of this ratio.

In the treated surface zone, the atomic ratio O/C is generally less than 0.40 and preferably less than 0.30. Advantageously, the atomic ratio F/C is greater than 50% of the ratio O/C.

In one preferred embodiment of the invention, while respecting the general conditions described above, the article does not simultaneously have a ratio O/C of at least 0.079 and a ratio F/C ranging from 89% to 291% of the ratio O/C.

ESCA spectroscopy (Electron Spectroscopy for Chemical Analysis), which is used to measure the oxygen, carbon and fluorine contents, is described in particular in "Practical Surface Analysis", Vol. 1 D. Briggs and M. P. Seah, Eds., J. Wiley & Sons Ltd., 1990. The proportions of oxygen, carbon and fluorine are all measured under the same conditions (depth, etc.).

A second subject of the present invention relates to a process for printing a polyolefin-based article by means of a toner by electrophotography, in which an article is used of which at least one surface zone comprises at least one polyolefin and has been treated by an oxidation and fluorination treatment so as to have fluorine and oxygen at the surface in concentrations such that the atomic ratio of oxygen to carbon (O/C) is at least 0.06 and that the atomic ratio of fluorine to carbon (F/C) has a value of at least 30% of that of the ratio O/C and not more than 350% of this ratio, and this article is printed by means of a toner by electrophotography.

The proportions of oxygen, carbon and fluorine are measured as indicated above.

The article can be treated either over the totality of its surface or over one or more zones of its surface, corresponding to the preceding definitions. For example, in the case of a multilayer film only one of whose two outer layers is polyolefin-based, it is possible to surface-treat this layer only, or even a certain zone of this layer, without departing from the scope of the present invention. The abovementioned values relating to the concentrations of oxygen and fluorine apply only, of course, to the zones comprising at least one polyolefin which have been effectively surface-treated.

The surface treatment by means of oxygen and fluorine can be carried out by any known method, continuously or batchwise, in one or more steps, provided that it leads to the abovementioned ratios F/C and O/C. The preferences indicated above relating to the values of these ratios still apply. Specific examples of surface treatment are given in the documents U.S. Pat. No. 4,296,151 and WO 93/24559.

The term fluorination is used to denote any known treatment carried out by means of a gaseous mixture containing fluorine which allows the fluorine to be bonded chemically to a plastic; examples thereof are also given in the two documents cited above. Preference is given to the use of a mixture of nitrogen and from 1 to 10% by volume of fluorine. Good results have been obtained by heating the chamber and/or the gaseous mixture during the fluorination step, preferably at a temperature of from 30 to 80° C. The duration of treatment is, of course, a function of the entirety of the operating conditions. The duration of the fluorination is generally short. The duration of fluorination is advantageously not more than 12 seconds. Preferably, it does not exceed 6 seconds, and more preferably still it does not go beyond 4 seconds.

The term oxidation is intended to denote any known treatment which allows the oxygen to be bonded chemically to a plastic. A well-known example of such treatment consists in utilizing a gaseous mixture containing oxygen (and, optionally, an inert gas such as nitrogen). Other examples of oxidation steps will be given below ("high-energy surface oxidation steps").

Preferably, the steps of fluorination and oxidation are combined, the process of surface treatment therefore comprising an oxyfluorination step: that is, a treatment by means of a gaseous mixture comprising both oxygen and fluorine (and, optionally, an inert gas). In accordance with one particularly simple embodiment, the process consists solely in an oxyfluorination step.

In accordance with another embodiment, the oxidation comprises a high-energy surface oxidation step. This embodiment leads to excellent results.

The term "high-energy surface oxidation" is intended to denote any high-energy oxidative treatment such as flame treatment, corona discharge, plasma treatment in the presence of oxygen, treatment with ozone, or else an oxygen oxidation step with heating to a temperature lower than the melting temperature of the material of the zone, and also combinations of two or more of these treatments.

When using oxygen oxidation with heating, the zone is brought preferably to a temperature which is lower by from 20 to 90° C. than the melting temperature of its constituent material. This heating can be carried out by any known means, for example by infrared radiation or by hot-air blowing.

Preferably, the high-energy surface oxidation comprises a corona treatment. It is advantageous to combine an oxidation with heating and a corona treatment.

The high-energy surface oxidation and the fluorination can take place in either order. They can also be simultaneous, for example by a cold-plasma treatment, as described in particular in J. Appl. Polym. Sc., Appl. Polym. Symp., Vol. 46, 61 (1990) and in J. Appl. Polym. Sc., Vol. 50, 585 (1993), or by oxyfluorination with heating. Generally, it is preferred that these treatments be separated in terms of time. In this case,. it is preferred most particularly that at least one fluorination step be preceded by at least one high-energy surface oxidation step. In particular, the combination of a corona treatment with a subsequent oxyfluorination leads to excellent results. The various steps may be separated by any desired time periods provided that the activation effect of a given step still remains at the time of the subsequent step. It is preferred moreover, for reasons of productivity as well, to conduct the entirety of the surface treatment continuously, the various steps set out above being carried out in succession and without significant delay. With particular preference, the surface treatment is carried out in line with the steps of manufacturing the articles (extrusion, etc.).

The process of surface treatment thus defined makes it possible to obtain articles to which the adhesion of toners is excellent, even when printing takes place several months after their manufacture.

What is claimed is:

1. Article of which at least one surface zone comprises at least one polyolefin and has been printed by means of a toner by an electrophotographic technique, in which the printed zone contains no toner printing primer and in which the adhesion of the toner to the article is such that it withstands a stripping force of at least 0.4 N/mm exerted by means of an adhesive tape, wherein the printed surface zone has been surface-treated be means of oxygen and fluorine before its printing.

2. Article according to claim 1, in the form of a film.

3. Article according to claim 1, whose treated and printed surface zone consists essentially of a propylene polymer or of a mixture of from 50 to 99% (relative to the total weight of the polymers) of at least one propylene polymer and from 50 to 1% of at least one ethylene polymer.

4. Article according to claim 1, in which the said surface zone contains fluorine and oxygen at the surface in concentrations such that the atomic ratio of oxygen to carbon (O/C), measured by ESCA spectroscopy at a depth of 1.5 nm, is at least 0.06 and in that the atomic ratio of fluorine to carbon (F/C) has a value of at least 30% of that of the ratio O/C and not more than 350% of this ratio.

5. Article according to claim 1, in which said surface zone does not simultaneously have a ratio O/C of at least 0.079 and a ratio F/C ranging from 89% to 291% of the ratio O/C, wherein each of said ratios is an atomic ratio.

6. Process for printing a polyolefin-based article by means of a toner by electrophotography, in which an article is used of which at least one surface zone comprises at least one polyolefin and has been treated by an oxidation and fluorination treatment so as to have fluorine and oxygen at the surface in concentrations such that the atomic ratio of oxygen to carbon (O/C) is at least 0.06 and that the atomic ratio of fluorine to carbon (F/C) has a value of at least 30% of that of the ratio O/C and not more than 350% of this ratio, and this article is printed by means of a toner by electrophotography.

7. Process according to claim 6, in which the oxidation treatment comprises a high-energy surface oxidation.

8. Process according to claim 7, in which the high-energy surface oxidation treatment comprises a corona treatment.

* * * * *